US011834883B2

(12) United States Patent
Krammer

(10) Patent No.: US 11,834,883 B2
(45) Date of Patent: Dec. 5, 2023

(54) ACTUATING ARM DRIVE WITH SPRING GUIDE

(71) Applicant: Julius Blum GmbH, Hoechst (AT)

(72) Inventor: Bernhard Krammer, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 64 days.

(21) Appl. No.: 17/478,448

(22) Filed: Sep. 17, 2021

(65) Prior Publication Data

US 2022/0003034 A1 Jan. 6, 2022

Related U.S. Application Data

(63) Continuation of application No. PCT/AT2020/060033, filed on Feb. 6, 2020.

(30) Foreign Application Priority Data

Mar. 20, 2019 (AT) ..... A 50239/2019

(51) Int. Cl.
*E05F 1/10* (2006.01)
*E05F 1/12* (2006.01)

(52) U.S. Cl.
CPC ..... *E05F 1/105* (2013.01); *E05F 1/1253* (2013.01); *E05Y 2201/474* (2013.01); *E05Y 2900/20* (2013.01)

(58) Field of Classification Search
CPC ..... E05F 1/105; E05F 1/1058; E05F 1/1253; E05F 1/1261
See application file for complete search history.

(56) References Cited

U.S. PATENT DOCUMENTS 7,178,202 B2 * 2/2007 Hirtsiefer ..... E05D 15/46 16/366
7,240,974 B2 * 7/2007 Hirtsiefer ..... E05F 1/1058 312/109
7,562,757 B2 * 7/2009 Dubach ..... E05F 5/00 312/319.2
8,439,458 B2 * 5/2013 Netzer ..... E05F 15/63 312/319.2
9,719,283 B2 * 8/2017 Holzapfel ..... A47B 96/00
(Continued)

FOREIGN PATENT DOCUMENTS

AT 515493 9/2015
CN 203879997 10/2014
(Continued)

OTHER PUBLICATIONS

International Search Report dated Apr. 23, 2020 in International (PCT) Application No. PCT/AT2020/060033.

*Primary Examiner* — Jeffrey O'Brien
(74) *Attorney, Agent, or Firm* — Wenderoth, Lind & Ponack, L.L.P.

(57) ABSTRACT

An actuating arm drive for driving a movably mounted furniture part of a furniture item, includes at least one arrangement consisting of a compression spring and at least one guiding device for guiding the compression spring. The at least one guiding device has an at least partly variable diameter in order to compensate for a radial clearance between the compression spring and the guiding device, taking into account the change in diameter of the compression spring when the compression spring is loaded.

10 Claims, 6 Drawing Sheets

(56) References Cited

U.S. PATENT DOCUMENTS

| | | | | |
|---|---|---|---|---|
| 10,317,092 | B2 * | 6/2019 | Desor | F24C 15/023 |
| 10,487,554 | B2 * | 11/2019 | Lubetz | F16H 25/18 |
| 10,519,707 | B2 * | 12/2019 | Cappellotto | E05D 15/46 |
| 11,319,741 | B2 * | 5/2022 | Talpe | E05F 3/20 |
| 2008/0121490 | A1 * | 5/2008 | Dubach | E05F 1/1058 192/17 D |
| 2010/0162847 | A1 * | 7/2010 | Gassner | E05F 1/1058 74/490.07 |
| 2016/0333620 | A1 * | 11/2016 | Holzapfel | E05F 1/1058 |
| 2018/0347251 | A1 * | 12/2018 | Cappellotto | E05D 15/46 |
| 2019/0071911 | A1 * | 3/2019 | Brunnmayr | E05F 1/1058 |
| 2021/0079706 | A1 * | 3/2021 | Hirtsiefer | E05F 1/1058 |

FOREIGN PATENT DOCUMENTS

| | | |
|---|---|---|
| CN | 107461100 | 12/2017 |
| CN | 108368721 | 8/2018 |
| CN | 109154175 | 1/2019 |
| DE | 1 660 550 | 8/1953 |
| DE | 10 2004 031 147 | 1/2006 |
| EP | 1 612 449 | 1/2006 |
| JP | 62-124339 | 8/1987 |
| WO | 2015/135005 | 9/2015 |
| WO | 2017/093290 | 6/2017 |

* cited by examiner

ACTUATING ARM DRIVE WITH SPRING GUIDE

BACKGROUND OF THE INVENTION

The present invention concerns an actuating arm drive for driving a moveably mounted furniture part of an article of furniture having at least one arrangement comprising a compression spring and at least one guide device for guiding the compression spring.

Actuating arm drives having a compression spring and at least one guide device for avoiding buckling movements of the compression springs upon compression of the compression springs are known from the state of the art. In that respect, guide devices arranged in the interior of the compression spring in the form of, for example, bars arranged in an internal space formed by the compression spring are also known. It is further known to design guide devices in the form of sleeves enclosing the compression springs.

A disadvantage with the actuating arm drives with guide devices as described hereinbefore known from the state of the art is that such guide devices have to be designed for the smallest occuring inside diameter or the largest occuring outside diameter in respect of the compression spring. If now the compression spring is loaded, its inside diameter or its outside diameter becomes larger and there is a radial clearance between the compression spring and the guide device.

That therefore permits a small buckling movement of the compression spring upon compression thereof until it comes into contact with the guide device. That "coming into contact" causes an enormously disruptive noise during the use of such a spring guide and increased wear at the guide device.

Therefore, the object of the present invention is to provide a spring guide which is improved over the state of the art as well as an actuating arm drive having at least one such spring guide and an article of furniture having at least one such actuating arm drive.

SUMMARY OF THE INVENTION

That object is attained by an actuating arm drive including at least one guide device having a diameter which is at least region-wise variable (i.e., variable over at least a portion of a length thereof) in order to compensate for a radial clearance between the compression spring and the guide device having regard to the change in diameter of the compression spring when the compression spring is loaded.

As a result, it is possible for the guide device to always bear snugly against the compression spring, over the entire length of the compression spring and in all positions of the compression spring which arise due to different loadings of the compression spring. Thus, the guide device can support the compression spring in all positions thereof against buckling of the compression spring whereby it is possible to counteract a severely disruptive noise occurring during the use of such a spring guide and increased wear at the guide device, as are both the case in the state of the art.

In other words, the guide device therefore always bears in play-free relationship against the compression spring and thus prevents a buckling collapse and a severely disruptive noise involved therewith.

The efficiency of the spring guide can also be optimized in that way, as a compression and/or expansion movement of the compression spring, which takes place substantially in a straight line, that is to say a compression or expansion movement of the compression spring which is free from buckling, can be implemented.

Manufacturing-induced tolerances in the diameter of the compression spring can also be compensated for by the prestressed snug contact in respect of the guide device.

An article of furniture having at least one such actuating arm drive and a furniture part mounted moveably thereto is also provided.

In that respect, preferably the guide device is in the form of a sleeve. That permits a way of manufacturing the guide device which saves on material and thus costs compared to a guide device which, for example, is in the form of a bar.

Particularly preferably, the guide device in the form of a sleeve is slotted in an axial direction and is prestressed in a radial direction. Such a design of the guide device makes it possible to provide a guide device which is variable in diameter by simple means.

To achieve such a prestressing, an outside diameter of a guide device in a non-prestressed position can be between 0.01 mm and 0.3 mm, preferably between 0.05 mm and 0.1 mm, greater than a smallest inside diameter of a compression spring.

In that respect, it can be advantageous if the at least one guide device is arranged at least partially in the interior of the compression spring. That has the advantage over an outwardly disposed guide device that it requires less material and less space, as the guide device is smaller in diameter and is arranged within the compression spring.

However, the at least one guide device can at least partially enclose the compression spring.

It can further be advantageous if a stabilization device is arranged within the at least one guide device or within the compression spring. In that way, the compression spring is additionally stabilized and buckling of the compression spring is even more reliably prevented.

The guide device can be produced from a thermoplastic, preferably polyoxymethylene. The use of that material permits simple and inexpensive manufacturing of the guide device. In addition, wear of the guide device and noise when the compression spring is loaded is reduced by virtue of the good sliding characterisitcs of that material.

In principle, however, all suitable materials are possible like for example various metals or other plastics.

BRIEF DESCRIPTION OF THE DRAWINGS

Further details and advantages of the present invention will be described in more detail hereinafter by means of the description of the Figures with reference to the embodiments illustrated in the drawings in which.

DETAILED DESCRIPTION OF THE INVENTION

Figure 1:
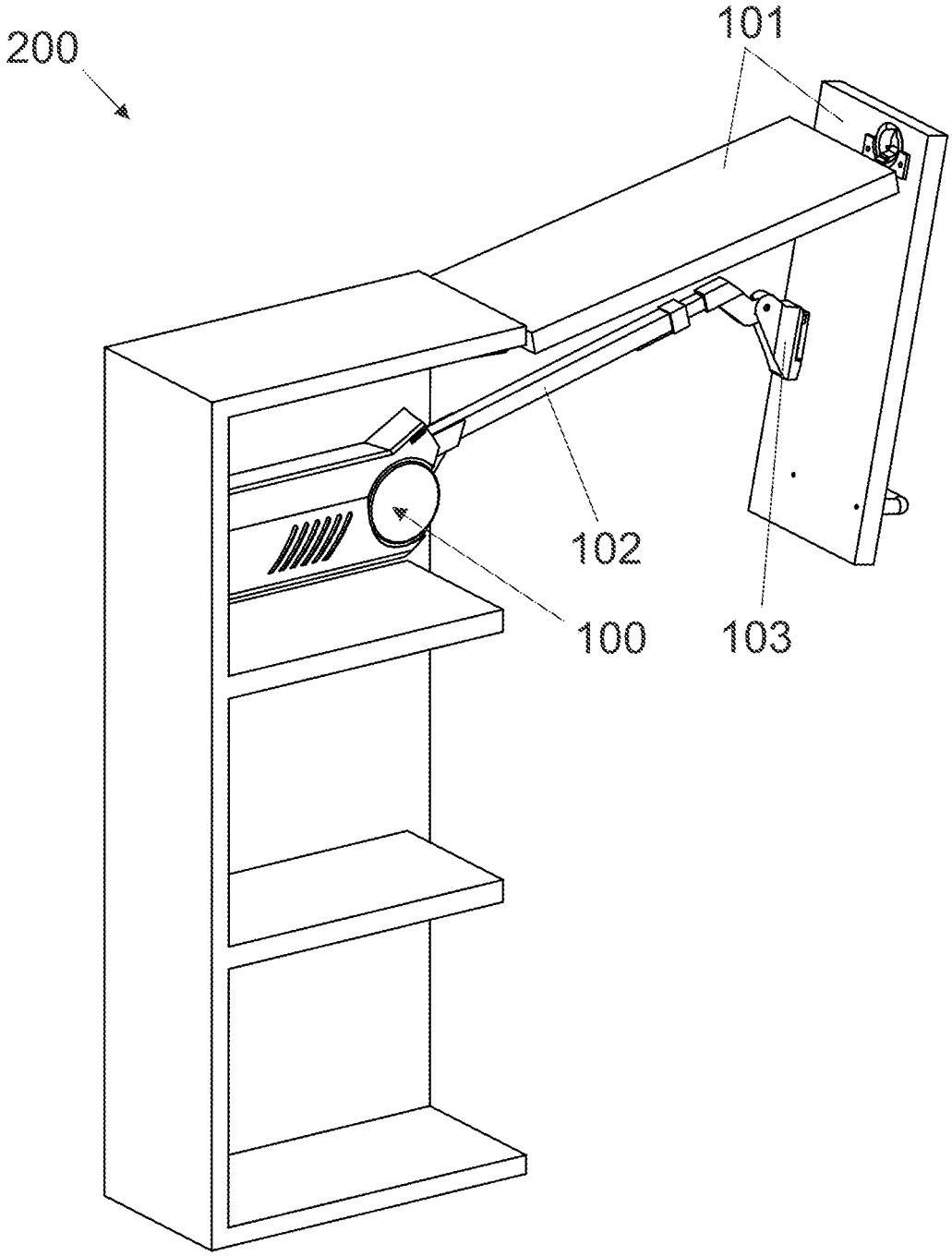
FIG. 1 is a perspective side view of an article of furniture according to the invention.

FIG. 1 shows a perspective view of an article of furniture 200 having an actuating arm drive 100 mounted in the interior of the article of furniture 200 and a furniture part 101 which is moveably mounted and driven by that actuating arm drive 100 and which—as illustrated—is in the form of a bi-fold lift flap. Unlike the illustrated system, the furniture part 101 can also be, for example, in the form of an upwardly pivotable flap. Furthermore, an actuating arm 102 and a fitment 103 are recognizable.

Figure 2:
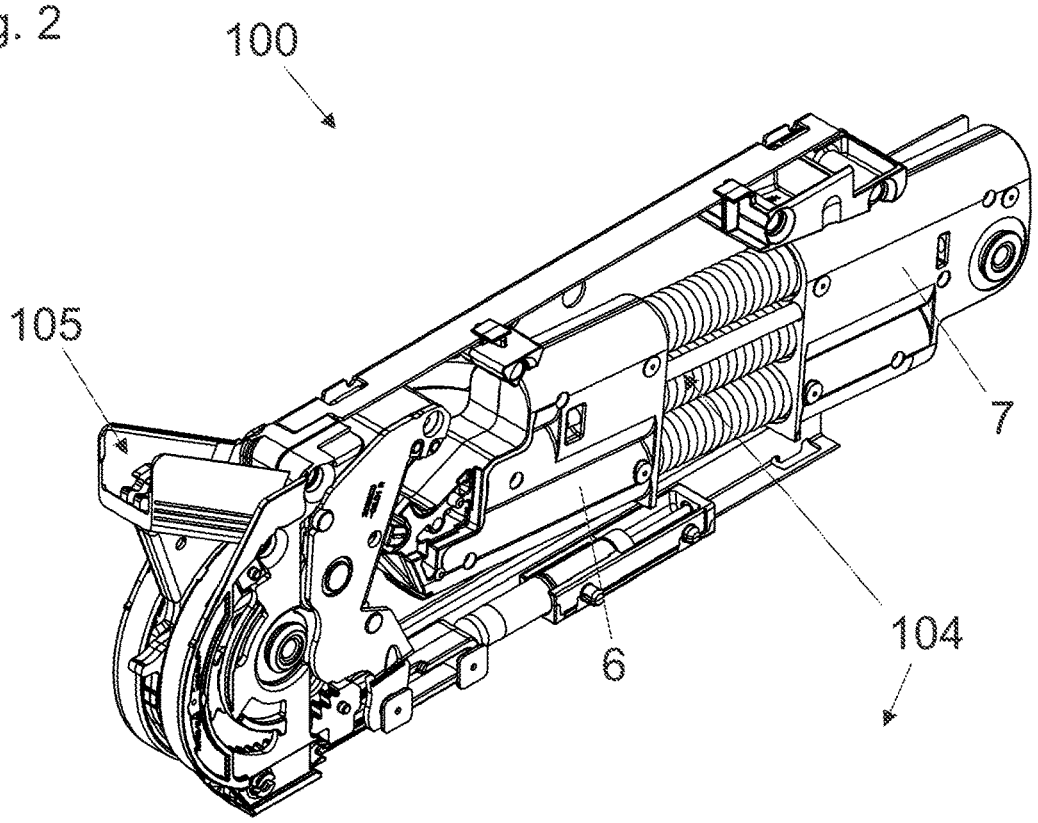
FIG. 2 is a perspective side view of an actuating arm drive according to the invention with the housing cover removed.

FIG. 2 shows a perspective view of an actuating arm drive 100 with a housing cover removed from the housing. The actuating arm drive 100 has a fixing location 105 for an actuating arm 102 for connecting the actuating arm drive 100 to the furniture part 101 to be moved. To apply force to the actuating arm 102, the actuating arm drive 100 further has a force storage means 104 in the form of a spring assembly which—as illustrated—acts on the actuating arm 102 by way of a transmission mechanism having a plurality of levers.

Figure 3:
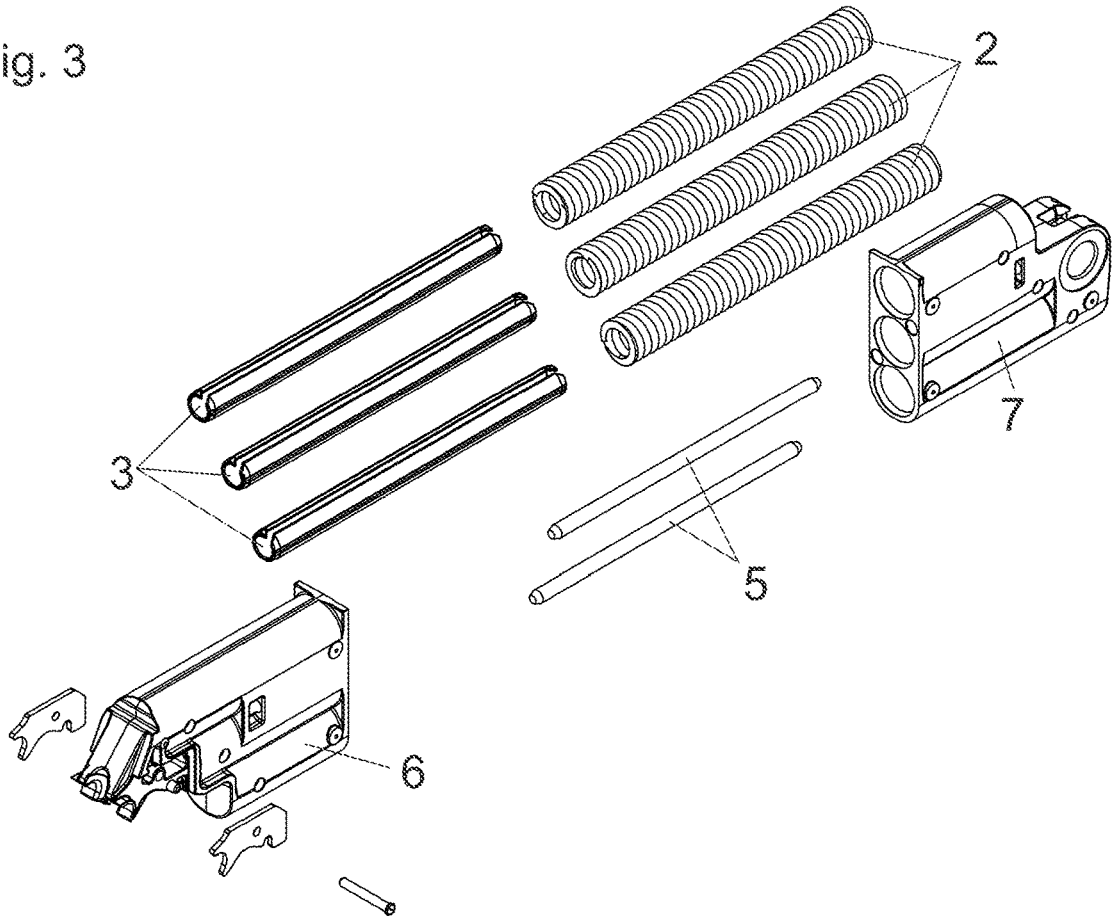
FIG. 3 is an exploded view of a force storage means.

The force storage means 104 is shown in an exploded view in FIG. 3. It has two base portions 6, 7 which are moveable relative to each other, and in the illustrated structure the second base portion 7 is mounted pivotably to the housing and the first base portion 6 cooperates directly with the transmission mechanism. The springs 2 of the force storage means 104 are arranged in mutually parallel relationship with respect to their longitudinal axes. The view substantially corresponds to the intended assembled position of the actuating arm drive 100 in the article of furniture 200, wherein the springs 2 (or their longitudinal axes) are arranged to lie or extend substantially horizontally. The force storage means 104 has guide devices 3 according to the invention arranged in the interior of the springs 2 to guide the springs 2. Guide bars 5 are provided for guiding the two base portions 6, 7 relative to each other.

Figure 4A:
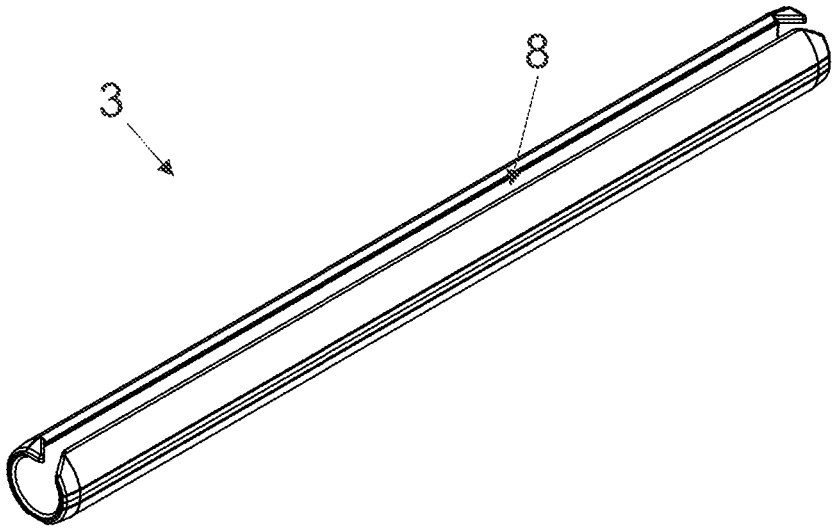
FIG. 4*a* is a perspective view of a guide device according to the invention.
Figure 4B:
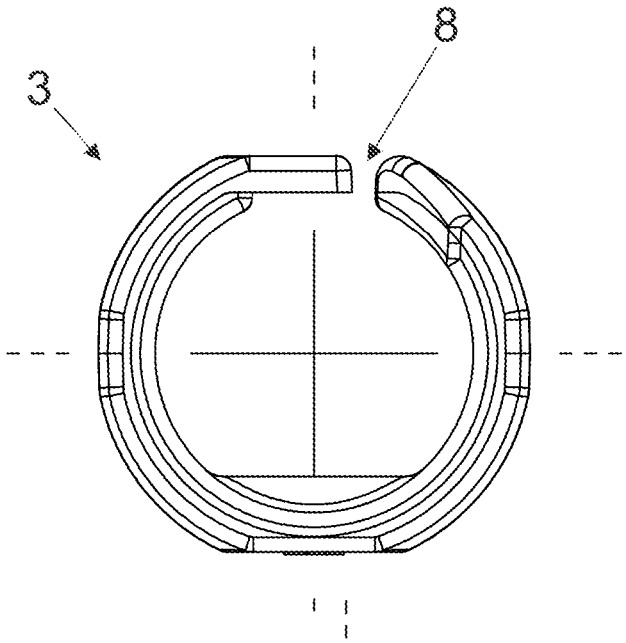
FIG. 4*b* is a front view of a guide device according to the invention.

FIG. 4*a* shows a perspective view of a guide device 3 according to the invention, while FIG. 4*b* shows a front view of a guide device 3 according to the invention. It is recognizable that the guide device 3 is in the form of a sleeve. Other suitable configurations however are also possible.

It is also shown that the guide device 3 has a slot 8 over the entire length thereof in axial direction. The slot 8 serves to permit changes in the diameter of the guide device 3.

In this arrangement, the guide device 3 is prestressed in a radial direction. To implement such prestressing, the outside diameter of the guide device 3 is at a minimum larger than the smallest inside diameter of the compression spring 2. Preferably, the outside diameter of a guide device in a non-prestressed position is between 0.01 mm and 0.3 mm, preferably between 0.05 and 0.1 mm, greater than a smallest inside diameter of the compression spring 2.

Figure 5A:
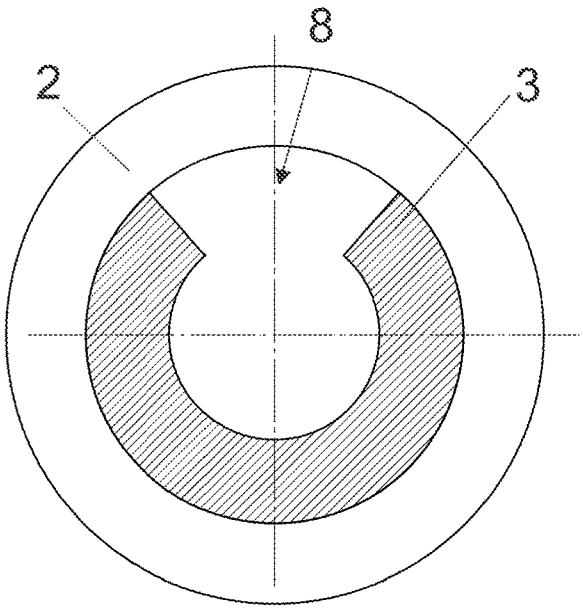
FIG. 5*a* is a diagrammatic sectional view of a spring guide according to the invention in a first position.

The function of the spring guide 1 according to the invention shall now be described with reference to FIGS. 5*a* to 5*c*. In FIG. 5*a*, the spring 2 is in a state of greatest possible loading. The inside diameter of the spring 2 is at a maximum in that state. It is obvious that the guide device 3, by virtue of its prestressing, assumes a larger diameter and thus still bears fully against the compression spring 2 despite the inside diameter of the spring 2 being at a maximum.

Figure 5B:
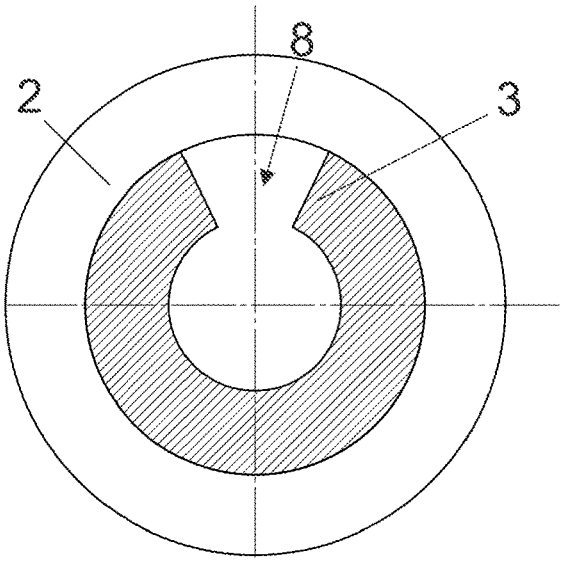
FIG. 5*b* is a diagrammatic sectional view of a spring guide according to the invention in a second position.

In FIG. 5*b*, the spring 2 is loaded to a degree whereby its inside diameter has somewhat increased relative to the unloaded condition of the spring. By virtue of the prestressing of the guide device 3, it expands in a radial direction and thus increases its outside diameter. As a result, the guide device 3 again bears fully against the compression spring 2 and can sufficiently guide the same and support it against a buckling collapse. It is also recognizable that the slot 8 has increased in width relative to when the compression spring 2 is unloaded to compensate for the change in the diameter of the guide device 3.

Figure 5C:
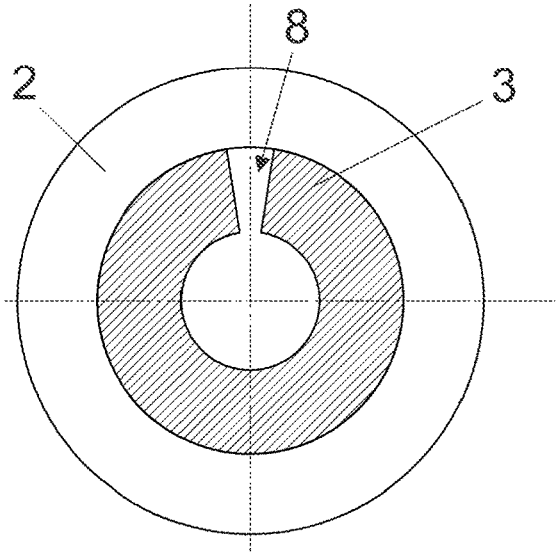
FIG. 5*c* is a diagrammatic sectional view of a spring guide according to the invention in a third position.

In FIG. 5*c*, the compression spring 2 is in a non-loaded condition and is therefore not compressed so that the inside diameter of the compression spring 2 is at a minimum. The spring guide 3 is fully stressed and bears snugly with its full external periphery against the compression spring 2, and so the width of the gap 8 is the narrowest.

The variation in the diameter of the guide device 3 is effected steplessly, for which reason the guide device in any state of the compression spring 2 and at any moment in time bears fully against the compression spring 2. As a result, the compression spring 2 is adequately guided and supported against a buckeling collapse at any moment in time and in any state of the compression spring 2.

Figure 6A:
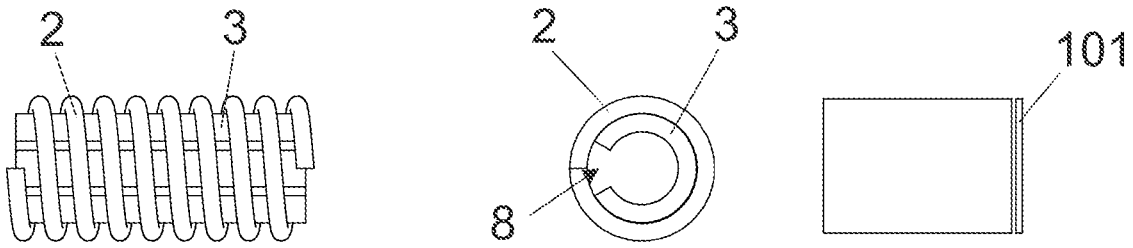
FIG. 6*a* shows various views of a diagrammatic illustration of a spring guide according to the invention in a first position.
Figure 6B:
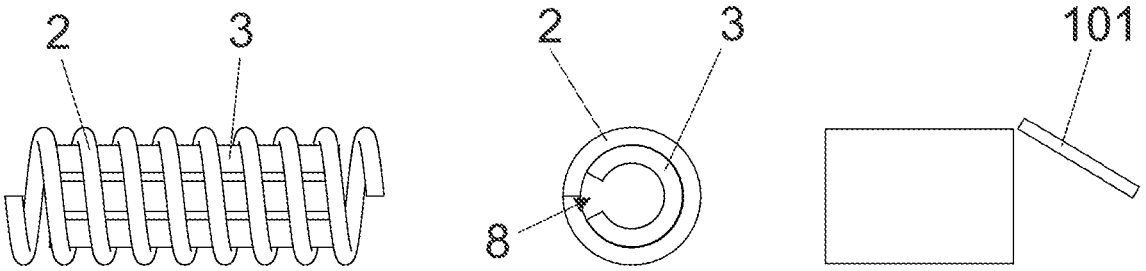
FIG. 6*b* shows various views of a diagrammatic illustration of a spring guide according to the invention in a second position.
Figure 6C:
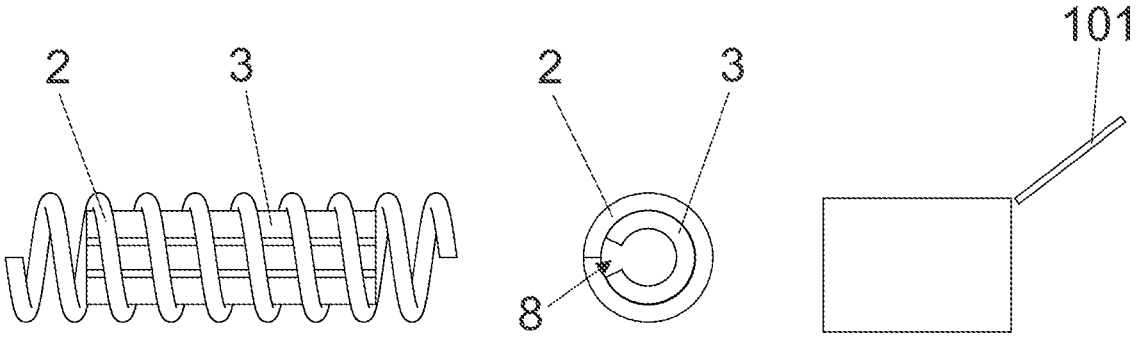
FIG. 6*c* shows various views of a diagrammatic illustration of a spring guide according to the invention in a third position.

For better understanding of the invention, FIGS. 6*a* to 6*c* in turn show a spring guide according to the invention in various positions from two views as well as the position of a moveable furniture part corresponding to the position of the spring guide.

In FIG. 6*a*, the moveable furniture part 101 is in a closed position. In that closed position, the spring 2 is compressed to its maximum and consequently has a maximum diameter and a minimum length. By virtue of its prestressed configuration, the guide device 3 has enlarged and bears snugly against the compression spring 2. In this position of the spring guide, the slot 8 is at its largest.

FIG. 6*b* shows the spring guide during an opening or closing procedure of the moveable furniture part 101. It is apparent that the spring 2 is compressed to a degree. Accordingly, in that position, the spring 2 also has an enlarged diameter and a shorter length than in the non-compressed position of the spring 2. By virtue of its prestressed configuration, the guide device 3 has increased in width and bears snugly against the compression spring 2. In this position of the spring guide, the slot 8 is larger than in a non-compressed position of the spring 2.

In FIG. 6*c*, the moveable furniture part 101 is in an open position. In that open position, the spring 2 is not compressed and accordingly has a minimum diameter and a maximum length. By virtue of its prestressed structure, the guide device 3 bears snugly against the compression spring 2. In this position of the spring guide, the slot 8 is at its smallest.

Figure 7A:
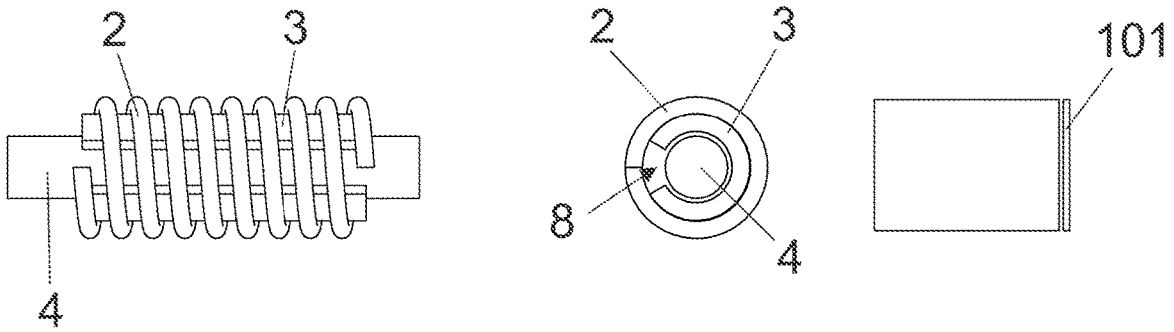
FIG. 7*a* shows various views of a diagrammatic illustration of a further embodiment of a spring guide according to the invention in a first position.
Figure 7B:
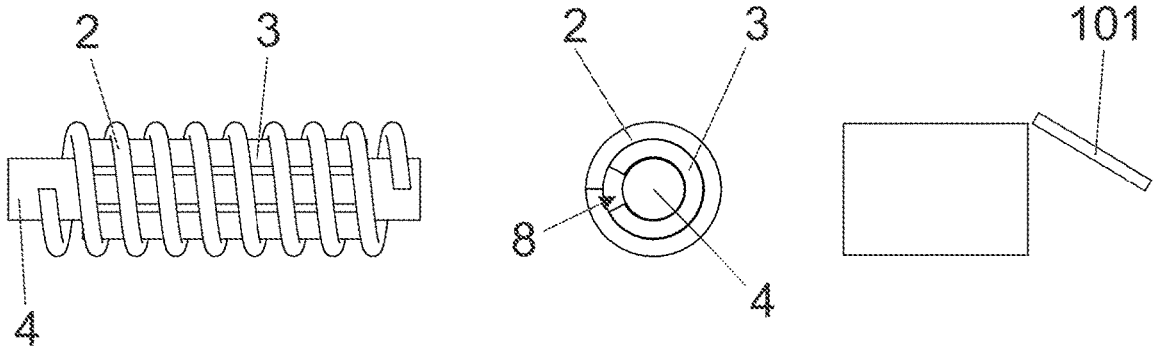
FIG. 7*b* shows various views of a diagrammatic illustration of a further embodiment of a spring guide according to the invention in a second position.
Figure 7C:
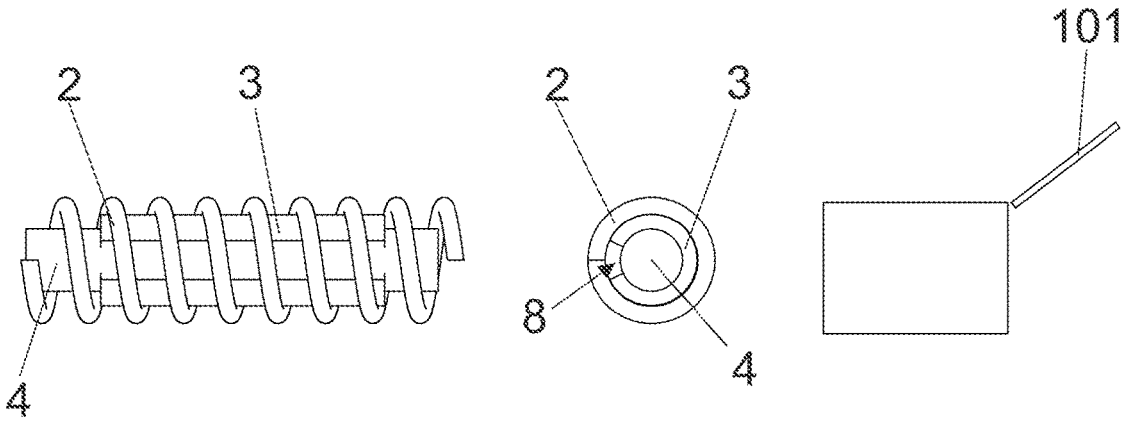
FIG. 7*c* shows various views of a diagrammatic illustration of a further embodiment of a spring guide according to the invention in a third position.

FIGS. 7*a* to 7*c* show a further embodiment of a spring guide according to the invention in various positions from two views as well as the position of a moveable furniture part corresponding to the position of the spring guide.

FIGS. 7*a* to 7*c* largely correspond to FIGS. 6*a* to 6*c*. The embodiment of FIGS. 7*a* to 7*c*, however, has a stabilization device 4. In this case, the stabilization device 4 is arranged in the interior of the guide device 3.

It is apparent that in a non-compressed position of the spring 2—in which the spring 2 therefore has a minimum diameter —, the guide device 3 bears against the stabilization device 4 in FIG. 6*c*. When the spring 2 is compressed (FIGS. 6*b* and 6*a*), the prestressed guide device 3 enlarges corresponding to the change in diameter of the spring 2 and still bears snugly against it. In that case, the guide device 3 lifts off the stabilization device 4.

LIST OF REFERENCES

1 spring guide
2 compression spring
3 guide device
4 stabilization device
5 guide bars
6 first base portion
7 second base portion
8 slot
100 actuating arm drive
101 furniture part
102 actuating arm
103 fitment
104 force storage means
105 fixing location
200 article of furniture

The invention claimed is:

1. An actuating arm drive for driving a moveably mounted furniture part of an article of furniture, the actuating arm drive comprising an arrangement including:

a compression spring; and a guide device for guiding the compression spring, wherein the guide device has a diameter variable over at least a portion of a length of the guide device in order to compensate for a radial clearance between the compression spring and the guide device due to a change in diameter of the compression spring when the compression spring is loaded, wherein the guide device is arranged at least partially in an interior of the compression spring, and wherein the arrangement further includes a stabilization device arranged within the guide device such that the stabilization device extends longitudinally beyond a first end and a second end of the guide device.

2. The actuating arm drive as set forth in claim 1, wherein the guide device is a sleeve.

3. The actuating arm drive as set forth in claim 2, wherein the sleeve has a slot extending in an axial direction of the sleeve.

4. The actuating arm drive as set forth in claim 1, wherein the guide device is prestressed in a radial direction.

5. The actuating arm drive as set forth in claim 1, wherein an outside diameter of the guide device in a non-prestressed position is between 0.01 mm and 0.3 mm greater than a smallest inside diameter of the compression spring.

6. The actuating arm drive as set forth in claim 1, wherein the guide device is made of a thermoplastic.

7. The actuating arm drive as set forth in claim 1, wherein the guide device is a first one of three guide devices.

8. An article of furniture comprising the actuating arm drive as set forth in claim 1 and a furniture part moveably mounted thereto.

9. The actuating arm drive as set forth in claim 5, wherein the outside diameter of the guide device in the non-prestressed position is between 0.05 mm and 0.1 mm greater than the smallest inside diameter of the compression spring.

10. The actuating arm drive as set forth in claim 6, wherein the guide device is made of polyoxymethylene.

* * * * *